United States Patent [19]

Moss et al.

[11] 4,450,307

[45] May 22, 1984

[54] HYDROXY-CONTAINING BICYCLOALKANE ETHER COMPOUNDS

[75] Inventors: Philip H. Moss; Edward C. Y. Nieh, both of Austin, Tex.

[73] Assignee: Texaco Inc., White Plains, N.Y.

[21] Appl. No.: 277,425

[22] Filed: Jun. 25, 1981

[51] Int. Cl.[3] ..... C07C 43/10; C07C 43/11

[52] U.S. Cl. ..... 568/665; 568/618; 568/612; 252/174.21

[58] Field of Search ..... 568/618, 665, 612

[56] References Cited

U.S. PATENT DOCUMENTS 3,354,225 11/1967 Kane ..... 568/665
3,370,080 2/1968 Bloch ..... 568/612 X
3,412,159 11/1968 Faber et al. ..... 568/665 X
4,140,724 2/1979 Nyi et al. ..... 568/665

OTHER PUBLICATIONS

Bruson, Jour. Amer. Chem. Soc., vol. 68 (1946), pp. 8–10.

*Primary Examiner*—Bernard Helfin
*Attorney, Agent, or Firm*—Jack H. Park; Walter D. Hunter; Richard A. Morgan

[57] ABSTRACT

New hydroxy-containing alkyl-substituted bicycloalkane ether compositions useful in the preparation of valuable detergent and lubricating compositions are obtained by reacting an alkyl-substituted 2-norbornene with a polyhydric alcohol in the presence of an acidic catalyst.

4 Claims, No Drawings

HYDROXY-CONTAINING BICYCLOALKANE ETHER COMPOUNDS

BACKGROUND OF THE INVENTION

1. Field of the Invention

This invention relates to new hydroxy-containing alkyl-substituted bicycloalkane ether compositions, and particularly hydroxy-containing ethers of akyl-substituted norbornanes, which are suited for use in making valuable detergent and lubricating compositions, and to an efficient process for preparing the said compositions from substituted norbornenes.

The invention specifically provides new hydroxy-containing alkyl-substituted bicycloalkane ether compositions represented by the formula

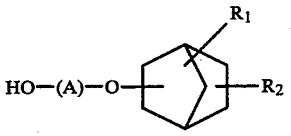

wherein $R_1$ is hydrogen or methyl, $R_2$ is a substantially linear alkyl group preferably containing from 4 to 26 carbon atoms, and A is a divalent hydrocarbon radical which preferably is a linear or branched radical containing from 2 to 12 carbon atoms.

The new compositions of the present invention possess a variety of valuable properties which make them suitable for use in many commercial applications, such as in the preparation of surface active agents, detergent compositions, lubricating compositions and the like. The new products are particularly useful in the preparation of detergent compositions, such as by reaction through the hydroxyl group with ethylene oxide, to form valuable polyoxyethylene derivatives. These products being free of alkylphenol groups are thus more biologically degradable and useful in the preparation of laundry or other cleaning products which are ultimately discharged into the sewer and readily attacked by bacterial agents.

2. Prior Art

Some biologically degradable detergent compositions, such as those described in U.S. Pat. No. 3,370,080 have been prepared by forming a norbornane alcohol by hydration of norbornene and then reacting the secondary alcohol with ethylene oxide. However, the products of the present invention represent a valuable improvement in that they give narrower and better regulated molecular weight distribution than obtainable by the alkoxylation of the secondary hydroxyl group of the prior known products.

Further advantage is also found in the fact that the new compositions can be prepared from inexpensive compounds, such as alpha-olefins and cyclic dienes, and obtained in high yields by a simple two-step process; thus presented an economic advantage over many of the known biologically degradable detergent compositions.

SUMMARY OF THE INVENTION

The new hydroxy-containing alkyl-substituted bicycloalkane ethers of the present invention can be generically described by the formula

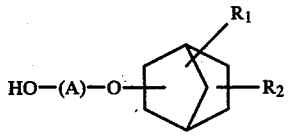

wherein $R_1$ is hydrogen or methyl, $R_2$ is a linear alkyl group and A is a divalent hydrocarbon radical. The new compounds are prepared by reacting an alkyl-substituted 2-norbornene with a polyhydric alcohol in the presence of an acidic catalyst.

DETAILED DESCRIPTION OF THE INVENTION

While $R_1$ in the above-described formula is preferably hydrogen, it may also be methyl.

$R_2$ in the above-described formula can be any linear alkyl group, such as, for example, butyl, amyl, hexyl, isohexyl, decyl, dodecyl, hexadecyl, nonadecyl radical, and the like. Particularly preferred are those compounds of the formula wherein $R_2$ is a linear alkyl group containing from 4 to 26 carbon atoms, and still more preferably from 4 to 14 carbon atoms.

A in the above-described formula can be any linear or branched divalent hydrocarbon radical having 2 to 12 carbon atoms. The radical HO—(A)—O— may be exemplified by radicals, such as hydroxyethoxy, hydroxybutoxy, hydroxypentoxy, hydroxyoctoxy, hydroxydodecoxy, hydroxyoctadecoxy, hydroxyoctadecenoxy, etc. Particularly preferred are the compounds of the formula wherein A is a linear aliphatic hydrocarbon radical containing from 2 to 6 carbon atoms such as an alkylene group of 2 to 4 carbon atoms as exemplified by ethylene, propylene, butylene, etc.

The hydroxy-containing alkyl-substituted bicycloalkane ether compositions of the present invention may be exemplified by the following: 5-(2-hydroxyethoxy)-2- and 3-hexyl norbornane. 5-(3-hydroxypropoxy)2- and 3-octyl norbornane, 5-(5-hydroxypentoxy)2- and 3-butyl norbornane, 5-(2-hydroxyethoxy)2- and 3-dodecyl norbornane, 5-(6-hydroxyhexoxy)2- and 3-heptyl norbornane, 5-(hydroxyethoxy)2- and 3-dodecyl norbornane, 5-(5-hydroxypentoxy)2- and 3-eicosyl norbornane 2- and 3-butyl norbornane, 2- and 3-octyl norbornane, and 5-(6-hydroxy-4-octenoxy)2- and 3-decyl norbornane.

The new compositions of the present invention can be prepared by a variety of methods but are preferably prepared by condensing an alpha-olefin with a cyclopentadiene or dicyclopentadiene as in a Diels-Alder type condensation reaction to form an alkyl-substituted norbornene, and then reacting the norbornene with the desired polyhydric alcohol in the presence of an acidic catalyst. It was unexpected to find that the polyhydric alcohols could be added to the alkyl-substituted norbornenes in the presence of the acidic catalyst to form the desired substituted norbornanes in view of certain disclosures in the prior art indicating that related acid catalyzed reactions with norbornenes resulted in many cases in a structural rearrangement. See, for example, Kock et al. Liebigs Ann. Chem. 638, 11 (1960).

The formation of the alkyl-substituted norbornenes by reacting an alpha-olefin with a cyclopentadiene or dicyclopentadiene can be illustrated by the following equation:

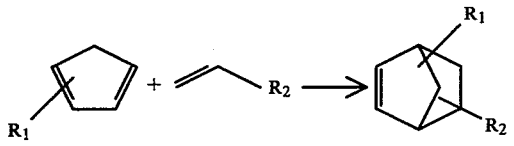

wherein $R_1$ may be hydrogen or methyl as described above and $R_2$ may be a linear alkyl group as described above. It is well known that the cyclopentadienes are in equilibrium with the corresponding dicyclopentadienes and the use of the dicyclopentadienes, as in some of the examples in this specification, is in effect addition of the cyclopentadiene as shown in the above equation.

The alpha-olefins used in the preparation of the alkyl-substituted norbornenes by the reaction shown above may be of any type but are preferably the 1-alkenes containing at least four carbon atoms, and preferably containing from 6 to 28 carbon atoms. Such olefins may be exemplified by 1-pentene, 1-hexene, 1-octene, 1-decene, 1-dodecene, 1-tetradecene, 1-octadecene, 1-eicosene, 3-butyloctene-1, 2,6-dimethyloctadecene-1, 3-amyldodecene-1, etc., and mixtures thereof. These alpha olefins are preferably obtained by cracking hydrocarbon wax or by telomerizing/ethylene.

The reaction between the alpha-olefin and the cyclopentadiene or dicyclopentadiene to form the alkyl-substituted norbornene as shown in the above equation can be accomplished by heating the components together in a sealed autoclave at a temperature generally ranging from about 150° C. to about 300° C., and more preferably at about 220° C. The pressure may vary as needed to keep reactants in the liquid state at the temperature selected and generally will range from about 1 to about 20 atmospheres. The components can be combined in a variety of different ratios varying from stoichiometric amounts up to an excess of either reactant. In general, it is preferred to utilize the alpha-olefin in large excess, e.g. from 2 to 6 molar excess. More specifically, cyclopentadiene to alpha-olefin molar ratios may vary from about 1:3 to 1:5 as needed or desired. Solvents may be utilized as desired, but in many cases the excess alpha-olefin furnishes sufficient fluidity for the desired condensation reaction. The desired alkylsubstituted norbornenes can be recovered from the reaction mixture by any suitable means, such as distillation, etc.

In view of the different steric arrangements that may result from this type of condensation, the resulting products will generally be a mixture of endo and exo derivatives as represented by the following illustration of the structure of endo-5-butyl-2-norbornene and exo-5-butyl-2-norbornene:

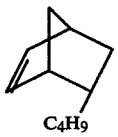

Endo-5-butyl-2-norbornene

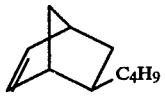

Exo-5-butyl-2-norbornene

Examples of these mixtures of steric isomers include, among others, a mixture of endo-5-octyl and exo-5-octyl-2-norbornene, mixture of endo-5-dodecyl and exo-5-dodecyl-2-norbornene, a mixture of endo-5-tetradecyl and exo-5-tetradecyl-2-norbornene, a mixture of endo-5-heptyl and exo-5-heptyl-2-norbornene, a mixture of endo-5-octadecyl and exo-5-octadecyl-2-norbornene, and mixture of endo-5-octyl and endo-5-octyl-2-norbornene. These isomers have closely related boiling points and react substantially the same in the formation of the new products of the invention so they can be used as a mixture without further separation.

The alkyl-substituted norbornenes prepared as above are then reacted with a polyhydric alcohol to form the desired hydroxy-substituted, alkyl-substituted bicycloalkane ethers. This reaction can be illustrated by the following equation:

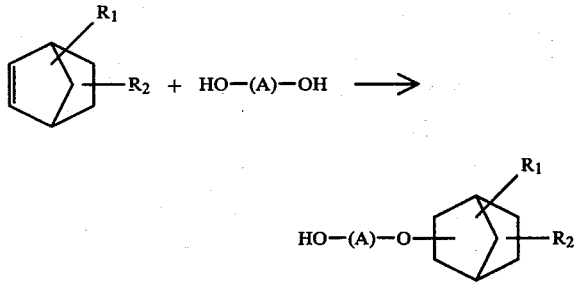

wherein $R_1$, $R_2$ and A are as described above in the generic formula for the products of the present invention.

The alcohols to be reacted with the substituted norbornenes according to the above process may be any dihydric hydrocarbon alcohol. Examples of such include, among others, ethylene glycol, 1,3-propanediol, 5-methyl-1, 6-hexanediol, 1,7-heptanediol, 1,8-octanediol, 1, 10-dodecanediol, 1,12-dodecandiol, 1,16-hexadecanediol, 1,2-cyclohexanediol, 6-butyl-1,10-decanediol, 2,5-dimethyl-1, 10-tetradecanediol and 1,8-pentadecanediol, mixtures thereof, etc.

The reaction is accomplished by heating the alkyl-substituted norbornene with the dihydric alcohol in the presence of an acidic catalyst. The acidic catalyst employed may be of the known Friedel-Crafts or Lewis acid catalysts. Such catalysts include, among others, boron trifluoride, boron trifluoride complexes, such as their ether complexes, hydrofluoric acid, aluminum chloride, ion-exchange resins, such as Amberlyst ®15, a cross-linked styrene-sulfonic acid resin manufactured by the Rohm and Haas Co., and Nafion ®, a perfluorocarbon supported perfluorosulfonic acid resin manufactured by E. I. du Pont de Nemours and Co., and mixtures thereof. Preferred catalysts to be utilized include the boron trifluoride and its complexes, particularly with ethers, such as, for example, boron trifluoride diethyl ether complex, boron trifluoride dipropyl ether complex, boron trifluoride dibutyl ether complex, and boron trifluoride cyclohexyl ether complex, etc., and mixtures thereof. Suitable substitutes include the corresponding boron tribromide and boron triiodide complexes. The amount of the acidic catalyst employed may vary over a wide range depending upon the catalyst selected, reactants and conditions. In general, the catalyst will vary from about 0.01% to 5% by weight of the reactants and more preferably from about 0.1% to 5% by weight of reactants.

The proportion of the alkyl-substituted norbornene and the polyhydric alcohol to be used in the reaction may vary over a wide range. In most cases, it is desirable to utilize the dihydric alcohol in large excess.

The new compositions of the invention may also be used for the preparation of lubricating compositions, plasticizing agents, etc.

To illustrate the preparation of the new compositions and some of their properties, the following examples are given. It is to be understood, however, that the examples are given only in the way of illustration and are not to be regarded as limiting the invention in any way.

EXAMPLE I

This example illustrates the preparation and properties of 5-(2-hydroxyethoxy) 2- and 3-hexyl norborane.

1-octane (1400 g) and dicyclopentadiene (280 g), technical grade, were reacted in a sealed autoclave at 220° C. over a period of about 3 hours. The reaction mixture was then distilled to yield a mixture of exo- and endo-5-hexyl 2-norbornene.

The exo- and endo-5-hexyl 2-norbornene (890 g) produced above was combined with ethylene glycol (1085 g), and boron trifluoride diethyl ether complex (25 ml) and the mixture heated at 115° C. for about 7.5 hours. The mixture was then dissolved in 1.5 liters of ether and washed several times with water, dried with calcium sulfate and concentrated. The product was distilled to recover a mixture of 5-(2-hydroxyethoxy) 2- and 3-hexyl norbornane (in 1048 g yield) which was a liquid. This product had 4.07 meq/g of acetylatable hydroxy groups (4.16 meq/g theoretical).

The above-described 5-(2-hydroxyethoxy) 2- and 3-hexyl norbornane (100 parts) is reacted with ethylene oxide in the presence of a trace potassium hydroxide to form a polyoxyalkylene derivative having about 10 oxyethylene units which exhibits good detergent properties.

EXAMPLE II

This example illustrates the preparation and properties of 5-(2-hydroxyethoxy) 2- and 3-octyl norbornane.

1-decene (5984 g) and technical grade dicyclopentadiene (770 g) were mixed in a sealed autoclave at 220° C. over a period of three hours. The resulting product was distilled to yield a mixture of exo- and endo-5-octyl 2-norbornene.

The exo- and endo-5-octyl 2-norbornene (1035 g) produced above was mixed with ethylene glycol (1240 g) and boron trifluoride diethyl ether complex (25 ml) and the mixture heated at 115° C. for about 7.5 hours. The product was dissolved in approximately 1.5 liters of ether, washed several times with water and the etheral solution was dried over calcium sulfate and concentrated. The product was distilled to recover a mixture of 5-(2-hydroxyethoxy) 2- and 3-octyl norbornane (in 935 g. yield) which was a liquid. This product had 3.7 meq/g of acetylatable hydroxy groups (theory 3.7 meq/g).

The 5-(2-hydroxyethoxy) 2- and 3-octyl norbornane (100 parts) produced above is reacted with ethylene oxide in the presence of a trace of sodium hydroxide to form a polyoxyethylene derivative having about 8 oxyethylene units. Similar products can be obtained by reaction with ethylene oxide to form materials having from 5 to 20 ethoxy units and exhibiting good detergent properties. Sulfate and sulfonate derivatives can also be prepared by reaction through the OH group.

EXAMPLE III

This example illustrates the preparation properties of 5-(2-hydroxyethoxy) 2- and 3-butyl norbornane.

1-hexene (928 g) and technical grade dicyclopentadiene (980 g) were reacted in a sealed autoclave at 220° C. over a period of several hours. The reaction mixture was distilled to give a mixture of exo- and endo-5-butyl 2-norbornene.

The mixture of exo- and endo-5-butyl 2-norbornene (910 g) produced above was combined with ethylene glycol (1620 g), boron trifluoride diethyl ether complex (25 ml) and the mixture heated at 115° C. for about 8 hours. The resulting mixture was dissolved in 1.5 liter of ether, washed several times with water, dried with calcium sulfate and concentrated. The product was distilled in vacuo to yield a mixture of 5-(2-hydroxyethoxy) 2- and 3-butyl norbornane, (952 g yield) which was a liquid. This product had 4.7 meq/g of acetylatable hydroxy groups (theory 4.7 meq/g).

The above-described product (100 parts) is reacted with ethylene oxide in the presence of a trace of potassium hydroxide to form a polyoxyalkylene derivative having about 9 oxyethylene units which had good detergent properties.

EXAMPLE IV

Example I is repeated with the excpetion that the ethylene glycol is replaced with an equivalent amount of 1,3-propanediol. Related results are obtained.

EXAMPLE V

Example III is repeated with the exception that the 1-hexene is replaced with equivalent amounts of each of the following: 1-decene, 1-dodecene, and 1-octadecene. Related results are obtained.

We claim as our invention:

1. A new compound comprising 5-(2-hydroxyethoxy) 2- and 3-alkyl norbornane.

2. A new compound comprising 5-(2-hydroxyethoxy) 2- and 3-octyl norbornane.

3. A new compound comprising 5-(2-hydroxyethoxy) 2- and 3-hexyl norbornane.

4. A new compound comprising 5-(2-hydroxyethoxy) 2- and 3-butyl norbornane.

* * * * *